US007024799B2

(12) United States Patent
Perret

(10) Patent No.: US 7,024,799 B2
(45) Date of Patent: Apr. 11, 2006

(54) METHOD FOR TREATING PRODUCTS WITH AIR, A PRODUCT TREATMENT DEVICE AND THE PRODUCTS THUS TREATED

(75) Inventor: Maurice Perret, Gruffy (FR)

(73) Assignee: Oddeis S.A., Paris (FR)

( * ) Notice: Subject to any disclaimer, the term of this patent is extended or adjusted under 35 U.S.C. 154(b) by 0 days.

(21) Appl. No.: 10/478,378

(22) PCT Filed: May 17, 2002

(86) PCT No.: PCT/FR02/01667

§ 371 (c)(1),
(2), (4) Date: May 28, 2004

(87) PCT Pub. No.: WO02/095312

PCT Pub. Date: Nov. 28, 2002

(65) Prior Publication Data

US 2004/0194335 A1 Oct. 7, 2004

(30) Foreign Application Priority Data

May 21, 2001 (FR) ..... 01 07088

(51) Int. Cl.
*F26B 21/06* (2006.01)

(52) U.S. Cl. ..... 34/495; 34/66; 34/78; 34/212; 34/219

(58) Field of Classification Search ..... 34/468, 34/467, 495, 62, 66, 78, 212, 219, 443, 493
See application file for complete search history.

(56) References Cited

U.S. PATENT DOCUMENTS

| | | | | |
|---|---|---|---|---|
| 2,935,009 | A * | 5/1960 | Cloud et al. | 454/180 |
| 4,050,164 | A | 9/1977 | Campbell | |
| 4,175,418 | A * | 11/1979 | Steffen et al. | 454/180 |
| 4,196,526 | A * | 4/1980 | Berti | 34/77 |
| 4,426,791 | A | 1/1984 | Coppa | |
| 4,530,167 | A | 7/1985 | Hotovy | |
| 4,688,332 | A * | 8/1987 | Kallestad et al. | 34/491 |

FOREIGN PATENT DOCUMENTS

| | | |
|---|---|---|
| CH | 684771 | 12/1994 |
| EP | 0055787 | 7/1982 |
| EP | 0095265 | 11/1983 |
| FR | 2681673 | 3/1993 |
| FR | 2778456 | 11/1999 |
| FR | 2780491 | 12/1999 |
| GB | 671085 | 4/1952 |
| WO | 94/12013 | 6/1994 |

* cited by examiner

*Primary Examiner*—Jiping Lu
(74) *Attorney, Agent, or Firm*—Young & Thompson

(57) ABSTRACT

The invention relates to a method for treating products with air in order to enable the conservation, storage and use thereof. Said invention also relates to a device for treating such products and the products obtained using said treatment method. The products (P) to be treated, such as a hay drier or other similar agricultural products, are loaded into a closed space (20) that is connected to a thermodynamic machine (21) which is controlled using a programmable automaton (22) and which is powered by an electrical cabinet (25). Three mass of water in air sensors (Q1, Q2 and Q3) determine the operation of the machine according to the desired treatment objectives both in terms of moisture in relation to the product treated and power consumption. The invention is suitable for treating diverse products such as agricultural products.

19 Claims, 2 Drawing Sheets

METHOD FOR TREATING PRODUCTS WITH AIR, A PRODUCT TREATMENT DEVICE AND THE PRODUCTS THUS TREATED

TITLE OF THE INVENTION

BACKGROUND OF THE INVENTION

The present invention relates to a process for the treatment of products with air so as to permit particularly their preservation, their storage and their use. It also relates to a device for treatment of such products and the products obtained by the treatment process.

DESCRIPTION OF THE RELATED ART

In the field of livestock feed, it has long been known to prepare fodder from various fodder plants that are cultivated for this purpose. The mature plants were gathered at harvest time and transferred into silos to dry in free air during the last days of summer. Suitably dried, the fodder was preserved for all the season in the course of which the fields no longer supplied enough plants and grass to permit raising livestock. But the drying techniques used a source of heat (sun or heater) for drying hay to promote the evaporation of the water it contains. However, the heating gives rise to a loss of quality of the fodder and more generally the treated products, and the energy cost is fairly often too high.

With more recent industrialization of agriculture in general and under the constraint of requirements of economic origin in the broadest sense, this mode of heating has been in competition with and often has been completely replaced by the use of replacement food such as food in the form of granules and above all animal farinas which have been seen to be catastrophic both for the effects on the livestock and on the public health.

However, the return of ancestral techniques for treating fodder is no longer to be considered.

Moreover, numerous agricultural activities are treated by industry particularly for the packaging of grains (cereal harvest) in silos particularly which permit preserving the harvest sold to farmers before resale during subsequent periods. However, this economic added value is justified only by treatment means that the agricultural industry uses.

As a result of the above, there exists a need to treat the harvest such that it will be reusable later in each agricultural employment or more generally in the industry using treated agricultural products.

SUMMARY OF THE INVENTION

To this end, the invention relates to a process for treatment of products with air treated by means of a thermodynamic treatment machine, which consists:

in calculating the operating regime of the thermodynamic treatment machine defined by an assembly of predetermined values of parameters of operating comprising:
- the operative condition of power driven fans driving air to be treated by the treatment machine;
- the condition of opening access registers of air to be treated by the treatment machine;
- the operative condition of the compressor or compressors of the treatment machine;
- the switching condition of a reversing valve reversing the operation of the thermodynamic treatment machine;

- the weight of the products to be treated;
- a weight of water Qtheo to be extracted per unit time, said mass use of Qtheo being determined by:
- the nature of the products to be treated;
- the desired duration of treatment;

for a treatment object predetermined by a combination of at least:
- a criterion of quality of treatment measured on the products as the quantity of dry material;
- a duration of treatment;
- an electrical consumption of the treatment machine;
- an economic cost;
- in loading into a receptacle at least partially closed a load of products to be treated;
- in removing at most a fraction of air from the load of products and, as the case may be, mixing it with the external air;
- controlling the flow rate, the temperature and/or the quantity of saturating steam of the treated air so as to produce a treated airflow, such that there will be applied a dehumidification treatment, of dehumidifying, heating and/or cooling the treatment air; and
- reinjecting at least a portion of the treated airflow into the load;

and applying the treatment at least to the extent that the treatment objective is not achieved for at least one assembly of predetermined values of the operating parameters.

The invention also relates to a treatment device for products using the process of the invention.

The invention also relates to products treated by the device of the invention.

BRIEF DESCRIPTION OF THE DRAWINGS

Other characteristics and advantages of the present invention will become better understood from the help of the description and the accompanying drawings, wherein.

DESCRIPTION OF THE PREFERRED EMBODIMENTS

Figure 1:
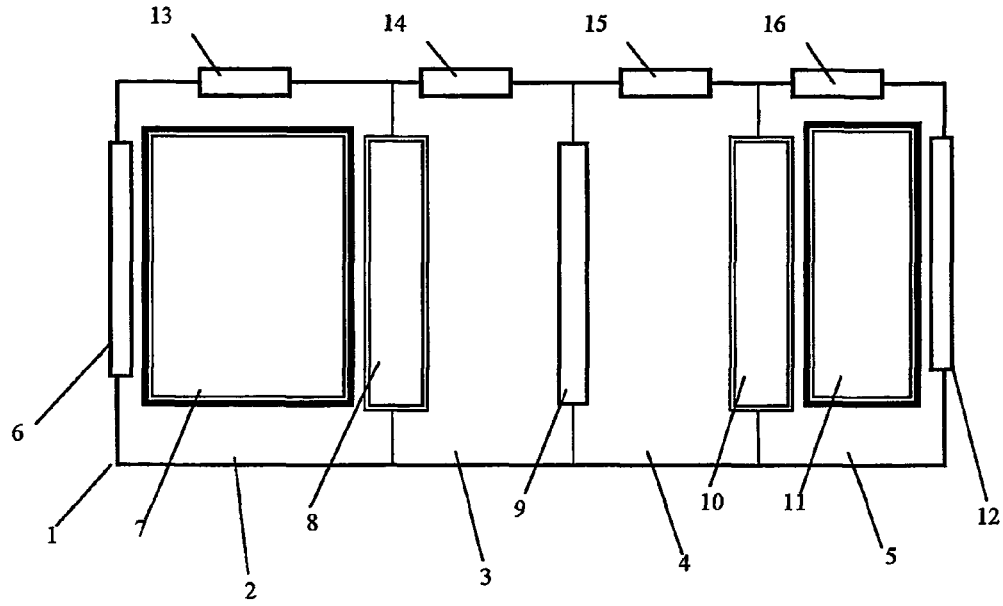
FIG. 1: a block diagram of an essential portion of the device of the invention.

FIG. 1 shows a block diagram of an essential portion of the device of the invention in one embodiment. This essential portion comprises a thermodynamic machine for treatment of air. The latter comprises, in a sealed cabinet 1, a plurality of compartments 2–5 in which the air to be treated circulates between two access doors 6 and 12. The machine for treating air of the device of the invention operates with airflows which can proceed:

from the door 6 to the door 12;

from the door 12 to the door 6; and in two directions between the doors 6 and 12.

The sealed cabinet 1 also comprises a series of registers 13–16 which permit with the help of flap diaphragms, for example each register being mobilized by an actuator (not shown) controllable from a central automaton (not shown in FIG. 1), regulating the introduction or expulsion of external or ambient air, or else the air from a receptacle containing the products to be treated, such as agricultural products, such as grain or fodder. The registers 13–16 also permit adjusting the airflow rates and pressures in the treatment machine.

The two end compartments 2 and 5 comprise respectively an evaporator-condenser device 7 and an evaporator-condenser device 11. In the partition separating the compartment 7 in which has been disposed the evaporator-condenser 7, and the other internal compartment (here shown at 3), there is mounted the battery 8 of the evaporator-condenser 7. In the partition separating the compartment 5 in which has been disposed the evaporator-condenser 11, and the other internal compartment (here shown at 4), there is mounted the battery 10 of the evaporator-condenser 12.

Each evaporator-condenser coacts with a power-driven fan comprised by a centrifugal fan and an electric motor whose operation is controlled by a central automaton (not shown in FIG. 1). The evaporator-condenser also comprises a battery for heat exchange with the air in the course of treatment. Each battery is thus constituted by a serpentine coil in which circulates a heat transfer fluid and against which the air in the course of treatment circulates. According to whether the evaporator-condenser works as an evaporator or as a condenser, the battery is either warmer than the air in the course of treatment or colder than the air in the course of treatment. As can be seen from FIG. 4, these two batteries comprised each of a heat exchanger are connected between themselves and with other components by a fluid circuit traversed by a heat transfer fluid such that the airflow which passes through each of the exchangers exchanges thermal energy with the fluid circuit.

In the embodiment of FIG. 1, the cabinet 1 also comprises a partition separating the two central compartments 3 and 4. The partition separating these two central compartments is provided with a register, called register C, comprising a diaphragm with flaps, remotely controlled by an actuator (not shown in FIG. 1) and which is maneuvered under the control of the central automaton mentioned above (not shown in FIG. 1).

In this embodiment, the central compartments are provided with at least one register 14 and preferably two registers 14 and 15, each comprising a diaphragm with flaps remotely operable by an actuator (not shown in FIG. 1) and which is maneuvered under the control of the central automaton mentioned above (not shown in FIG. 1).

In what follows, each register of the device for treatment of the invention is designated by:

"A" register 13 on the compartment 2 of the power-driven fan 7;

"B" register 14 on the compartment 3 supporting the battery of the first evaporator-condenser 8;

"C" register 9 between the two central compartments 3 and 4;

"D" register 14 on the compartment 4 supporting the battery of the second evaporator-condenser 10;

"E" register 15 on the compartment 5 of the power-driven fan 11.

Figure 2:
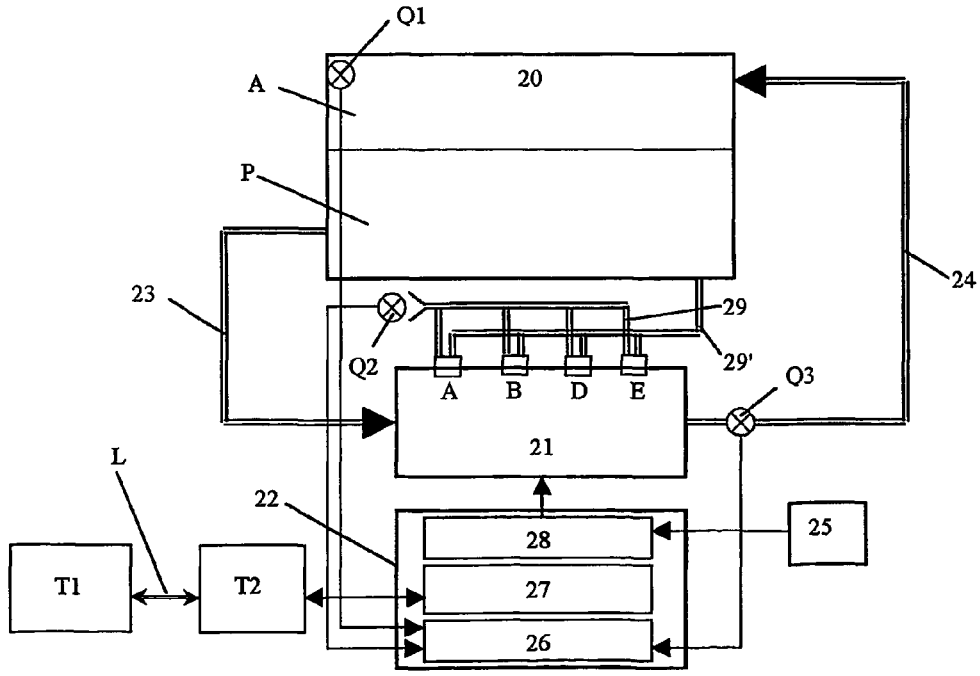
FIG. 2: a block diagram of an embodiment of the, treatment device using the process of the invention.

To control the operation of the device of FIG. 1, there is shown in FIG. 2, the assembly of the device for practicing the process of the invention. In FIG. 2, a treatment receptacle or volume 20 is loaded into a base zone P with a predetermined quantity of agricultural products to be treated. From an upper portion A is provided in the closed treatment volume 20 in which circulates a mixture of air from the thermodynamic treatment machine 21 and the air from the mass of the agricultural products to be treated P. Such a closed volume 20 for treatment can be a crop dryer.

The atmosphere of the closed volume 20 is communicated to the thermodynamic machine for treatment by two passages for air to be treated 23 and treatment air 24. According to the treatment applied according to the process of the invention, which will be described later, one or the other of the two passages 23 and 24 is connected:

to the door 6 and the door 12;

to the door 12 or the door 6; or in both directions to the doors 6 and 12.

In one embodiment, the passageway 23 for recycling is omitted and the door 6 of the sealed cabinet 1 is directly supplied with external air. In this case, the treatment machine 1 blows treatment air from the door 12 through the passage 24 and external air is sucked in through the door 6.

The thermodynamic machine 21 for treatment of air and its registers A, B, D and E can also be connected to the external air by a passage 29 which, in the embodiment of FIG. 2, permits supplying each of the four registers. In another embodiment, only certain ones of the registers are connected to the passage 29. In another embodiment, certain of the registers are connected independently to the external air by its own passage 29.

The thermodynamic machine 21 for treatment of air and its registers A, B, D and E can also be connected to the closed volume 20 by a passage 29' which, in the embodiment of FIG. 2, permits each of the four registers to exchange airflow with the closed volume. In another embodiment, only certain of the registers are connected to the passage 29'. In another embodiment, certain ones of the registers are connected independently to the closed volume 20 by its own passage 29'.

When a register A, B, D or E is connected both to the passage 29 to external air and to a passage 29' with the closed volume 20, it can comprise two diaphragms with separate flaps with their own actuator controlled independently by the central automaton 20 which is a commercially available programmable automaton.

The connection of the principal passages 23 and 24 and of registers 29' to the closed volume can take place according to at least two embodiments. In a first embodiment, the airflow for treatment from the treatment machine 21 passes through the thickness of the products to be treated. Because of this, the passage connections for blowing treatment air and the passage connections for sucking in air to be treated are disposed on opposite sides of the product P to be treated, each at one or several points according to the treatment circumstances. In a second embodiment, the product P to be treated is bathed in its own atmosphere in the closed volume 20 and the treatment of the invention is applied to this atmosphere. The connections of the principal passages 23 and 24, and 29' of the registers are thus disposed in opposition in the atmosphere which bathes the product to be treated.

As will be seen later on, a passage 29' connected to a predetermined register A, B, D or E can be connected, not to the closed volume 20, but to an energy recovery module.

The device of the invention also comprises two or three detectors to determine the quantity of water vapor in the air which passes through the thermodynamic machine. These detectors measure respectively:

Q1: the quantity of water vapor contained in the air from at least one closed volume 20 in which are located the agricultural products P to be treated;

Q2: the quantity of water vapor contained in the external air both in the closed volume 20 in which the agricultural products P to be treated are located and in the thermodynamic machine 21 in which are disposed the treatment compartments of the air described in FIG. 1;

Q3: the quantity of water vapor contained in the air from the outlet of treatment through door 6 or 12 according to the direction of operation of the thermodynamic machine 21.

In the embodiment in which the passage 23 is missing, it is unnecessary to have a detector Q1 to measure the content of water in the air at the outlet of the closed volume 20.

The three detectors of the quantity of water in the air, Q1 to Q3, have output terminals which give electrical signals whose voltage is representative of the instantaneous measurement of the quantity of water in the air to which they pertain. These signals are transmitted by suitable means to the input terminals for measuring signals of the quantities of water in the air to control the operation of the device of the invention, which terminals are disposed on the mentioned control automaton 22.

The control automaton 22 comprises a treatment module 26 for the signals of measurement Q1 to Q3 whose outputs are communicated with a central processor 27 in which is executed a control program such that the process of the invention will be performed. The processor 27 activates as a function of the process of the invention an assembly 28 of modules which produce control signals which are respectively:

an actuating control module associated with each register A to E and which configures a control parameter of the condition of opening or closing, proportional or all or nothing according to the circumstances;

a control module for power-driven fan 7, 11 associated with each evaporator-condenser and which configures a control parameter of the operating condition of the motor, proportional or, preferably, all or nothing according to the circumstances;

a control module associated with each remotely controllable component of the fluid circuit which constitutes the thermodynamic machine for processing air which connects the batteries 8 and 10 of which one works as the evaporator and the other as the condenser and which will be described later.

The assembly 28 of the control modules of the programmable automaton 22 is electrically connected to an electrical supply cabinet 25 such that the control of the electrical consumption can be processed directly by the program executed by the processor 27. The criteria for management of electrical consumption take account of the electrical supply source, particularly the classes of frostiff as a function of the time or more generally of the date such that as a function of the desired economic efficiency of the treatment of agricultural products, the parameters of operation to control the treatment machine of the air will be determined to achieve the predetermined treatment objectives as a function of the determined values of the quantities Q1 to Q3 of water in the air in the course of the fixed duration of treatment.

In one embodiment, the control automaton 22 also comprises a remote surveillance means T1, T2 which comprises principally:

a module T1 adjacent the automaton which comprises a circuit to detect the values of parameters of operation of the machine and particularly the measurements Q1 to Q3 of the quantities of water in the air, the condition of operation of the fans and of the compressors of the thermodynamic machine, the condition of opening of the registers, the electrical consumption, etc., a circuit to detect the alarm values of the values detected of the parameters of operation, at least one alarm value is reached, a circuit to transmit the assembly of the instantaneous values and/or a history of this assembly over a predetermined period, a circuit to receive the values of control parameters and standard values brought up to date such that the operation of the device will be changed;

a module T2 disposed remotely and which comprises a circuit to receive data from the module T1 and particularly an alarm signal, and a history of the values and parameters of operation of the machine, a circuit to determine as a function of the received values of the parameters of operation of the machine, new reference values and/or control values for the parameters of operation of the machine, a specialized connection between the modules T1, T2.

With this remote surveillance means, it is possible that the machine will thus be able to be adapted as a function of accidental circumstances signaled by the alarms.

In one embodiment, the control automaton 22 also comprises a means to detect a situation of formation of frost on a cold battery or one of the two evaporator-condensers of the thermodynamic machine. The battery susceptible to the formation of frost obtained by accumulation of water in the form of solids extracted from the air in the course of treatment, comprises a temperature detector which detects that the cold battery has reached a temperature near the temperature of formation of frost, namely 0 to 4 degrees Celsius. The automaton 22, detecting this reference temperature, produces a control signal destined for the thermodynamic machine to reverse the operation of the thermodynamic machine so as to cause to pass it into a heating mode of its heat exchange fluid during a predetermined period or until the temperature of the cold battery rises to a predetermined value ensuring the disappearance of the frost, as will be described later with the help of FIG. 4.

In one embodiment, a pressure detector is disposed in the passage of access to each battery of the evaporator-condensers on the side by which the heat exchange fluid will be in the gaseous condition when the evaporator-condenser in question is in danger of the formation of frost. The central automaton 22 is connected to each pressure detector and comprises an estimator of the frost situation which executes the computation of a frost situation by computing a function depending on the flow rate of air and on the representative value of the pressure of the heat exchange fluid. The output values produced by the frost situation estimator, preferably "0" if there is no risk of frost and "1" if there is a frost situation, are registered in a table of values of frost and the upward value is transmitted as a controlled signal destined for the thermodynamic machine to reverse the thermodynamic machine operationally, as was described above.

It will be noted from what precedes, that the thermodynamic machine for treating air exchanged with the closed volume of agricultural products as a dryer, can work according to several modes of operation, and particularly:

in a drying mode in which the air from the upper portion of the closed volume is brought principally through the door 6 to the evaporator-condenser 7 and is extracted from the treatment machine through the door 12 such that the air will be dried by extraction of the water vapor contained in the air removed from the closed volume 20 by cooling;

in a heating mode in which the air removed from the closed volume is heated by the evaporator-condenser 10-11 such that the temperature of the air blown into the closed volume 20 will be reheated;

in a cooling mode or air conditioning.

These three modes of operation will be better understood from the help of the description which follows.

Figure 4:
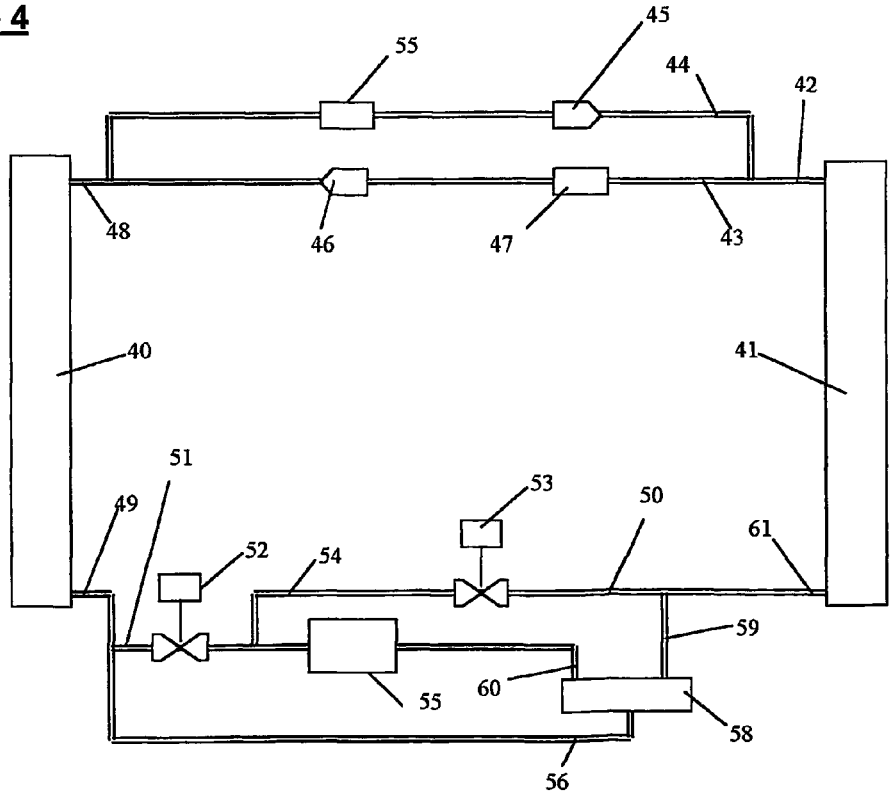
FIG. 4: a block diagram of a portion of the device of the invention.

Initially, it should be noted that the thermodynamic machine for treatment disposed in the compartments of the sealed cabinet 1 of FIG. 1, comprises in addition to the parts already described:

an electric motor to drive a fan of evaporator-condenser 7;

an electric motor to drive a fan of evaporator-condenser 11;

an electric motor or a compressor (not shown) which permits causing the exchange fluid to circulate in the passages which connect the batteries 8 associated with the evaporator-condenser 7 and 10 associated with the evaporator-condenser 11;

a plurality of electromagnetic relays to control various valves which are shown in the circuit of FIG. 4.

The electrical supplies are provided or controlled by suitable output terminals of the assembly 28 of control modules of the automaton 22 according to the execution of the program executed by the processor 27.

Figure 3:
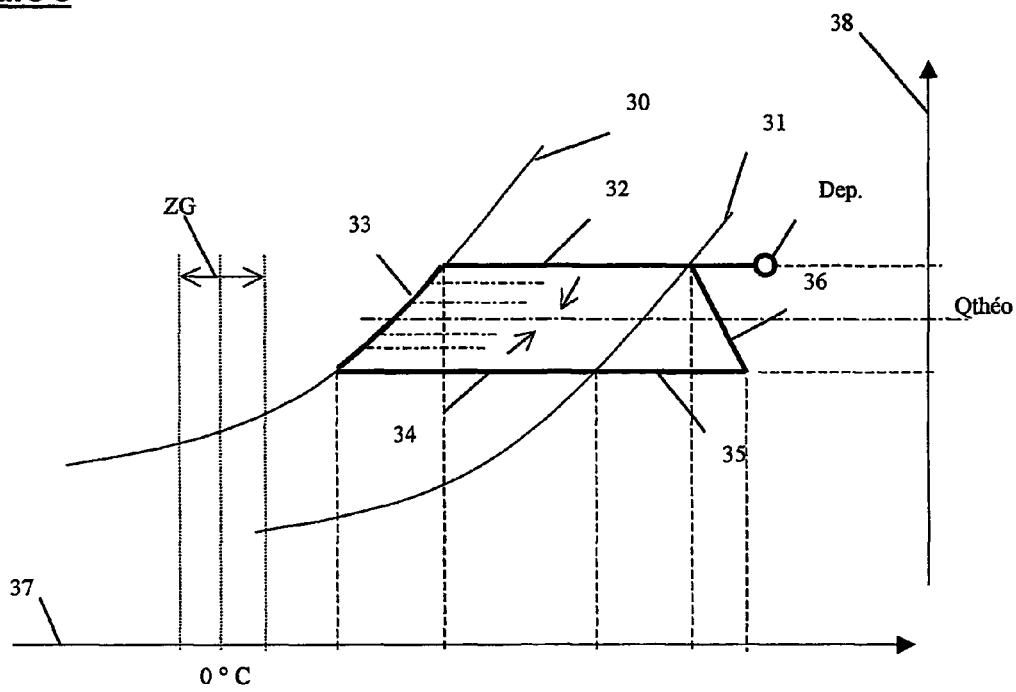
FIG. 3: a diagram representing the sequence of thermodynamic conditions of a device operating according to the process of the invention.

In FIG. 3, there is shown a diagram of the thermodynamic condition of the mass of air treated in the thermodynamic machine according to the process of the invention.

The axes 37 and 38 represent the measurement respectively of the temperature of the air and of the mass of water contained in the air per unit volume. The two curves 30 and 31 represent the thermodynamic conditions at constant quantity of moisture for two different values, and particularly the curve 30 which corresponds to the saturation point. The quantity of air contained in the air in the receptacle 20 is for example 18 grams per kilogram of air at 35° C. at the beginning point Dep of the treatment cycle. During step 32, an evaporation of the mass of water in the air is carried out at a given power.

Then, the air undergoes cooling during step 33 by giving up a quantity of water which can reach several grams of water per kilogram of air. The mass of liquid water produced during cooling 33 is determined by the difference of height of the diagram between the straight horizontal lines 32 and 34.

Then, there is carried out a step of condensation of the cooling fluid by passage of the mass of air over the condenser which works at predetermined constant power, then, by treating a constant mass of water, there is carried out a reheating 35 of the mass of air on the warm battery of the evaporator. Finally, the treated and hence dry air flow is cooled by reloading itself with water in contact with the mass of agricultural products P in the receptacle 20 to complete the cycle.

The automaton carries out a detection of the quantity of weight of water contained in the air such that the height of the cycle 32–36 tends to reduce in height, as is shown by the broken lines and the two arrows in the drawing of FIG. 3, up to the limit toward a limit mass of water Qtheo from which treatment can be stopped.

There is also shown a zone of the presence of frost ZG about the frost temperature as 0° C. When the thermodynamic machine reaches such a zone defined by a temperature gradient on opposite sides of the vertical straight line at 0° C., a process of defrosting is started which will be described later.

In FIG. 4, there is shown the fluid circuit passing through the cold batteries 6 of the evaporator-condensor 7 and hot batteries 10 of the evaporator-condensor 11 of the machine of FIG. 1. As shown, the fluid circuit comprises:

non-return flap valves 45, 46;

electromechanical valves 52, 53 which determine a single direction of circulation (graphically shown in the direction of the point of their drawing) and which are controlled electrically by suitable output modules of the central automaton (22; FIG. 2);

expanders 47 and 55;

a reversing valve 58;

a compressor 55 connected to an input 60 of the reversing 58 and whose operative condition is electrically controlled by a suitable output module of the central automaton (22; FIG. 2).

According to the operation in heating or defrosting mode or in dehumidification mode or in air conditioning mode, the direction of circulation of the fluid changes as will be explained.

The evaporator-condenser 40 comprises a first passage 48 connected in both directions of circulation by a passage 44 comprising a non-return flap valve 45 intermediate the inlet passage 42 of the evaporator-condenser 41. A passage 43 comprises a non-return flap valve 46 and an expander 47 such that the fluid can circulate from the evaporator-condenser 41 toward the evaporator-condenser 40.

The evaporator-condenser 40 comprises a second access passage 49 which is connected by a passage 51 and an electromechanical valve 52 connected to a first inlet passage 60 of a "three-way" valve 58.

A second inlet passage 59 of the "three-way" valve 58 is connected to the access passage 61 of the evaporator-condenser 41.

Finally, the second access passage 49 of the evaporator-condenser 41 is also connected by a passage 50 by means of electromagnetic valve 11 to an input passage 50 of the "three-way" valve 58. The outlet 56 of the "three-way" valve 58 is itself connected to the passage 49 of the evaporator-condenser 40. It will be noted that between the second access passages respectively 49 of the evaporator-condenser 40 and 61 of the evaporator-condenser 41, there is provided a reversing valve 56-59 with the help of the "three-way" valve 58.

Thanks to the reversing valve 58, the fluid circuit operates according to two modes, a heating mode and a cooling or air conditioning mode. In this way, as will be explained later, the evaporator and condenser exchange their functions.

In the heating mode, the fluid circulates principally through the passage 43 of the first passage 48, passes through non-return valve 46 and an expander 47 and arrives at the evaporator-condenser 40 which thus works as an evaporator by the passage 48. Then, the fluid being evaporated through the evaporator 40, returns through the passage 49 and 51, passes through the electromagnetic valve 52, enters the "three-way" valve 58 through the access passage 60, returns through the second passage 59 to arrive by means of the passage 61 at the evaporator-condenser 41 which operates in this case as a condenser. The frigorific fluid condenses in the gaseous state through the passage 61 to pass to the inlet 60 of the "three-way" valve 58 by means of the passage 50.

The frigorific fluid again leaves the three-way valve 58 by passage 56 and enters the evaporator-condenser 40 which thus operates as a condenser by means of the passage 49. It passes through the evaporator-condenser 40 and condenses to complete the cycle and to arrive at the passage 48.

The "three-way" valve 58 comprises electrical control means to operate either with its first inlet passage 60 open or with its second inlet passage 59 open. The control signals are produced according to the program executed by the processor 27 by means of the assembly of control modules 28 of the programmable automaton 22 of the device shown in FIG. 2.

In one embodiment, the evaporator 40 and the condenser 41 work at constant power, all or nothing. It follows that the fan motors associated therewith operate when they are supplied, or do not operate when, to execute a regulation of the thermodynamic cycle for treatment of the air, the program executed by the programmable automaton decides as a function of predetermined criteria of operation and as a function of predetermined criteria of electrical consumption, to operate or stop these latter.

In the following table in two parts, there is shown the control condition of each of the principal members of the device of the invention:

| mode | Condenser | evaporator | A | B | C | D | E | VI |
|---|---|---|---|---|---|---|---|---|
| heating (PaC) | M | M | F | O | F | O | F | not supplied |
| dehumidification | M | A | F | F | O | F | O | not supplied |
| air conditioning | M | M | F | 0 | F | O | F | supplied |
| Defrosting | M | M | F | 0 | F | F | F | supplied |

The codes in the columns of the table indicate respectively:

"M" the condenser and/or the evaporator are operated

"A" the condenser and/or the evaporator are stopped;

"O" the register A to E is open;

"F" the register A to E is closed;

"supplied" the reversing valve 58 is supplied;

"not supplied" the reversing valve 58 is not supplied.

In the first column of the table, there is indicated the four modes of operation which define the four lines of the table, namely the mode of operation when heating for the first line, the mode of operation when dehumidifying for the second line, the mode of operation when air conditioning for the third line. The table has been broken into two parts with repetition of the mode column, for better understanding.

It will be noted that, in another embodiment, the registers A to E are provided with means permitting controlling proportionally the degree of opening of the register such that the control automaton 22 controls a plurality of conditions of opening of at least one of the registers A to E between the open condition "0" and the closed condition "F".

It will be noted that the register A (13 in FIG. 1) is noted in the table always closed "F". In reality, in an embodiment of the invention, as a function of the detection of the instantaneous value of the external temperature Text, with ambient air in which air has been removed at least from the closed volume 20, there is carried out a proportional opening of the register A such that constant pressure is maintained in the high pressure circuits of the cabinet 1 (FIG. 1).

In one embodiment, there is carried out the measurement of the temperature of the external air Text and of the temperature Tevaporator in the cold battery of the evaporator 11, the register E (16 in FIG. 1) is controlled by proportional opening at the difference (Text−Tevaporator) such that the flow rate of the air through the battery 10 can be reduced.

The proportional controls of the registers A (13, FIG. 1) and E (16, FIG. 1) by the programmable automaton 21 (FIG. 2) permit causing the compressor of the fluid circuit to operate under optimum conditions no matter what the condition of the air established both outside (atmospheric) as inside the closed volume 20 in its upper portion A.

In the process of the invention, as a function of the measurements of the quantity of water in the air obtained by the help of detectors Q1 to Q3 and as a function of a predetermined theoretical quantity Qtheo recorded in the programmable automaton, the treatment by drying is carried out with the help of the following tests: if Q1 is greater than Q2 then take the air to be treated principally into the closed volume 20 (portion A); if Q2 is greater than Q1 then take the air to be treated principally into the exterior of the closed volume 20; if Q3 is greater than Qtheo then reduce the treatment power.

In one embodiment, the reduction of the treatment power is carried out by stopping the operation of fans 7 or 11. In one embodiment, the reduction of the treatment power is carried out by stopping the operation of the compressor, by stopping the operation of one compressor if several compressors are disposed in a series in the fluid circuit of the thermodynamic treatment machine, or by stopping the operation of at least one compressor stage if the compressor used has several stages.

In one embodiment, the registers E and D are supplied principally with recycled air, which is to say with air removed from the closed volume 20 or at least from its aerial portion A. The register B is preferably but not necessarily a register supplied only with external air. In one embodiment, each register A, B, D and E, or certain ones of them, is connected by an air passage having a predetermined diameter to the small airway A of the closed volume 20 such that there is provided totally or partly a mixture of the air undergoing treatment in one of the compartments 2–5 of the cabinet 1 with the air to be treated.

In one embodiment, the sealed cabinet 1 comprises air passageways on its air access doors 6 and 12 both toward at least two closed volumes to be treated or toward a closed volume to be treated and another volume to be heated by blowing hot air. In this way, the device of the invention permits better adapting itself to the economic constraints of cost of treatment because, for example in the operational mode of the device in dehumidification, applied to a fodder dryer, for example, it is possible to apply heating to another space such as a stable or another locality to which a warm air output from the device is connectable.

Operational modes of the thermodynamic machine of FIG. 1 will now be described.

In the dehumidifier mode, a treated airflow passes the registers 12 and 16 to the door 6.

In reversible heat pump mode, the reheating of the air or the re-cooling of the air can be controlled as a function of the needs for drying or preservation. The airflows circulate from the register 14 to the door 6 and from the register 15 to the register 12.

The registers 13 to 16 of the sealed cabinet 1 permit with the help of diaphragms with flaps to adjust the volume of air introduced into the different casings 2, 3, 4 and 5. Each register is actuated by an actuator (not shown) controllable from the central automaton (not shown in FIG. 1).

In what follows, there will be described various modes of operation of the components of the device of FIG. 1.

The cabinet 1 of the thermodynamic treatment center can be installed permanently adjacent treatment volumes, or else mounted in a transportable chassis, trailer which can be drawn by a tractor. In this case, the passages 23 and 24 (see FIG. 2) can either be carried or left permanently on the drying volume.

The compartment 2 is a principal power-driven fan casing which draws in the treated air. The compartment 3 is a distribution casing for air to be treated. The compartment 4 is an intermediate casing. The compartment 5 is a power-driven fan casing for exhaust which carries out the evacuation of undesirable surplus energy over the refrigeration energy in the case of needed heating or of the heat energy in the case cooling is needed. An aerial loop carries out drying of the treated air.

The power-driven fan 7 is of the centrifugal type. The power of its drive motor is suitable for the needs of the air circuit in question for blowing the treated air.

The evaporator-condenser 8 is used as a condenser in the heat pump operating mode or as a dehumidifier. The evaporator-condenser 8 is used as an evaporator in the cooling mode or in the defrosting mode by reversal of hot gas.

The inversion register 9 is open only in the dehumidifier mode and is closed in all the other operations. Its drive is preferably carried out with the help of an actuator working all or nothing (either open or closed) under the control of the central automaton 22.

The evaporator-condenser 10 is used as an evaporator in the heat pump operating mode or in the dehumidifier mode. The evaporator-condenser 10 is used as a condenser in the cooling mode or in the defrosting mode.

The power-driven fan 11 is of the centrifugal type. Operating in discharge, it evacuates the surplus energy: the power-driven fan operates in a reversible heat pump mode. It is stopped in the dehumidifier mode or in the deicing mode.

The register 13 operates to maintain high pressure. It is used in the heat pump mode or in the dehumidifier mode when the external temperature is low. This register permits deriving a portion of the air supplying the condenser 8 and permits maintaining an acceptable condensation pressure. The opening or closing of the register 13 is thus controlled by a power-driven actuator proportionally as a function of the proportional control produced by the central automaton 22.

The register 14 permits carrying out a reversal of the airflow in the dehumidifier mode. This register 14 remains open in all the other modes of operation. This register coacts with a power-driven actuator proportionally as a function of a proportional control produced by the central automaton 22. It moreover permits maintaining in the dehumidifier mode a maximum dehumidification power no matter what the weather conditions and no matter what the relative humidity of the treated air. This maintenance is carried out by derivation of a portion of the air passing through the evaporator. The inlet airflow is thus regulated proportionally to the outlet air temperature of the cold battery so as to achieve maximum condensation.

The register 15 permits carrying out a reversal of the airflows in the dehumidifier mode. This register 14 remains open in all other operating modes. This register 14 coacts with a power-driven actuator in all or nothing manner, under the action of control arranged by the central automaton 22.

The register 15 permits carrying out a reversal of the airflows in the dehumidification mode. This register 15 remains open in the dehumidifier mode and closed in all the other modes of operation. This register 15 coacts with a power-driven actuator in all or nothing fashion, under the influence of a control arranged by the central automaton 22. This register moreover permits holding the evaporation pressure lower than the critical evaporation pressure when the evaporator is traversed by air that is too hot. To this end, the actuator can be modified to work in a proportional mode, such that the register 16 derives a portion of this air so as to bring the evaporation pressure to a suitable value.

The principal modes of operation have been set forth from the point of view of all or nothing conditions of the parameters of operation or of control in the preceding table.

The different modes of operation are determined from, on the one hand, the needs of the client according to whether he prefers drying or preservation of the agricultural product and on the other hand of the weather conditions.

If the user desires preservation of his product, he selects, with the help of an input member for data internal to the central automaton 22, such as a tactile screen or a keyboard, a mode of incooling. The control of the operation is automatically managed with the help of the program, suitably initiated, which the central automaton 22 executes when the execution has been started. In all the other cases, the operation is automatic. The program of the central automaton 22 selects the best type of operation as a function of the quality of the external air and determines the value of the different parameters of operation to be used. Thus, by detecting the humidity of the air, the central automaton 22 predetermines an operation in the dehumidifier mode; but with dry air, the central automaton 22 determines operation in a heat pump mode and if there is the detection of frost on the evaporator, the central automaton 22 determines operation in a defrosting mode.

There will now be described the air circuits as a function of the different types of operation. In the drawing function, the operation is identical to an air/air heat pump. The air taken in from the exterior or in the closed volume in the case of a dryer, enters by the register 15, the register 9 being closed. It passes through the cold battery 10 which thus works as an evaporator. The inlet air cools and loses its energy. It is drawn through by the ventilator 11 and is discharged to the exterior by means of the discharge mouth 12. The cooling circuit ensures the transfer of the energy thus recovered.

In one embodiment, the energy thus available is used either in the form of heat for another thermodynamic treatment process, like heating, or else recycled by a suitable machine.

The treated air is returned to the hot battery 8 which thus works as a condenser. The dry air from the exterior or in the dryer, enters at the same time by means of the register 14. It passes through the hot battery 8, is reheated and takes up energy. It expands and could thus absorb a maximum of water molecules by passing through the material to be dried. It is drawn through by the power driven fan 7 and is blown into the agricultural product to be treated by means of the outlet mouth or door 6.

There will now be described the operation in the defrosting mode. The central automaton 22 receives a signal of the detection of the presence of frost on the evaporator. The program executed on the automaton 22 triggers, after a delay period which can be equal to zero, the reversal of the three-way valve and the stopping of the power-driven fan 11. The hot battery 8 becomes a cold battery which thus works as an evaporator and the cold battery becomes a hot battery which thus works as a condenser.

The dry air taken from the exterior or from the dryer, enters by means of the register 14. It passes through the cold battery 8 and gives up all its energy. It is drawn through by the power-driven fan 7 before being discharged by the mouth 6. The cooling circuit transfers all this energy to the batter 10 which is not supplied with air and which as a result heats up very rapidly. The frost melts and the recovered water is discharged to the outside.

As soon as the central automaton 22 detects that there is no more frost, it stops the cooling circuit and starts the power-driven fan 11 so as to dry the battery 10. After the lapse of a predetermined drying period, the program executed by the central automaton 22 reverses again the three-way valve and restarts the machine in the reheating mode as a heat pump as defined above.

There will now be described the operation in the mode of dehumidifying moist air.

The power-driven fan 11 is stopped. The humid air taken from the exterior or from the dryer, enters by means of the register 16 and the mouth 12. It passes through the cold battery 10, called in this an evaporator. It cools and reaches a so-called dew point temperature. It condenses on the cold battery, discharges the air which it carries and loses all its energy. The cooling circuit transfers all of this recovered energy to the hot battery 8 (sensible energy and latent energy). The air without its water which leaves through the battery 10, passes through the register 9, passes through the hot battery 8 and is reheated to a temperature above the initial inlet temperature. The thermodynamic machine receives the restitution of the latent energy contained in the air to be dehumidified and the energy consumed by the compressor to cause the cooling liquid to pass from a low pressure level to a high pressure level. The air expands so as to be able to absorb more water and is blown toward the material to be dried wit the help of the power-driven fan 7 and the blowing mouth 6. No matter what the initial humidity of the air to be treated, the evaporating power of the blown air remains of the same quality.

There will now be described the operation in the cooling or air conditioning mode.

The reversing valve is powered and the cycle is reversed. It is necessary to evacuate the heat (excess heat energy). The air taken from the exterior or the dryer, enters the register 14 (the register 9 is closed). It passes through the cold battery 8, in this case the evaporator. It is cooled and loses its energy. It is sucked in by the power-driven fan 7, and is blown into the product to be cooled by means of the blower mouth 6. The cooling circuit ensures the transfer of energy thus recovered, to the hot battery 10 called in this case a condenser. The air taken from the exterior or from the dryer, enters at the same time by means of the registers 15. It passes through the hot battery 10, is reheated and takes on energy. It is sucked in by the power-driven fan 11 and is discharged; and in the same way rejects the excess heat energy to the exterior by means of the mouth 12.

There will now be described a means to optimize the cooling operation of the machine. The means to optimize the cooling operation of the machine comprises a module for maintaining optimum condensation pressure. This mode of operation is triggered particularly when the external temperature is low. It can be controlled by the central automaton 22 with the help of its computer-operated program.

In the case of operation at low temperature, the register 13 opens to a degree of opening which is a function of the decrease of the condensation pressure. A portion of the air sucked in by the power-driven fan 7 enters through the register 13. The hot battery 8 is less supplied with cold air, the air entering through the register 14. As temperature rises, the power of the compressor remains constant and at the same time the condensation pressure returns to a correct value.

The means to optimize the cooling function of the machine comprises a module to limit the upper values of the evaporation pressure (high external temperature).

In the case of operation at a high external temperature, in operation as a heat pump re-heater, the program executed by the central automaton 22 controls the maintenance of a correct evaporation pressure by means of the register 16. In the case of operation at high external temperature, the register 16 opens proportionally as a function of the increase of evaporation pressure. A portion of the air drawn in by the power-driven fan 11 enters through the register 16; the cold battery 10 is less supplied with hot air (air entering through the register 15). Its temperature again falls, the power of the compressor being constant, and at the same time the evaporation pressure returns to a correct volume.

The means to optimize the cooling operation of the machine comprises an operating module for maintaining the dehumidifying power.

In the case of operation in the dehumidifying mode, when the external temperature is high, the quantity of water contained in the air can be too great despite a relatively low relative humidity. For example, for a temperature of 32° C. and a humidity of 40%, the weight contained in a kilogram of dry air is 12 g. This quantity is too high to ensure correct drying. In this case, the cooling power to be used to cool the air to its dew point (16.5° C.) and to permit substantial condensation of the humidity contained in the air is very high. So as to overcome this problem, by means of the register 14, the program executed on the central automaton 22 controls the inlet of a portion of the air sucked in by the power-driven pump 7. The quantity of air passing through the cold battery 10 decreases, its temperature falls. The power of the compressor being held constant by the central automaton 22, the temperature at the outlet of the battery falls and the dehumidifying power remains optimum. The centralized control of the machine permanently controls, in this case, the temperature of the air at the outlet of the evaporator and, if need be, manages proportionally the opening of the derivation register 14.

The process of the invention comprises a preliminary step to calculate the operating regime of the treatment machine adapted to a treatment objective. The operating regime is defined by an assembly of predetermined values of operating parameters which depend on the material constituting the treatment device of the invention. In particular, certain operating parameters describe the geometric dimensions of the machine such as for example the length, the cross-sections and the pressure drops of the passages or of the treatment compartments of the thermodynamic treatment machine. These parameters are fixed and are selected during production or installation of the machine. Other operating parameters are determined once for all time at least during an experimental period, such as the installed electrical power, or the losses from the thermal insulation and depend on the choice of construction during installation of the treatment device. Finally, other parameters can be modified or controlled during the execution of a treatment or a series of treatments as has been described above.

The treatment objective depends on the nature of the treatment and on the products undergoing treatment. It is determined in a manner to optimize the treatment result by respecting the technical constraints, particularly safeguarding the treatment device and the products undergoing treatment, and economic constraints taking account of the cost of energy consumed (particularly the cost of electrical energy supply) but also amortization of the installations and of the treatment device.

The treatment results, and particularly the treatment objectives, are measured by parameters relating to the products to be treated. For example, for products such as fodder and for a drying treatment, the user can fix the quantity of dry materials which will be compared to a theoretical threshold quantity at the end of treatment Qtheo which has been expressed above. The user can also fix a drying time and take account in this connection of climatic constraints.

It will be noted that among the operating parameters, certain of them are controllable such as the operating condition of the actuable elements of the treatment device, as has been described. The values of these parameters are thus modified while carrying out treatment.

The treatment device is connected to a receptacle for products to be treated. Several receptacles can be mounted in series or in a star arrangement on the same device. Moreover, these receptacles are not necessarily completely sealed, whether it is desirable to maintain a certain quantity of humidity or whether perfect sealing would be too costly to obtain.

As a result, the communication of the treatment air with a receptacle can be arranged such that the air flow circulates through the mass of products to be treated, or not. It is a matter of circumstances which depend on the products and their receptacle.

It has also been described that the treatment process could carry out a humidification of the treatment airflow. In particular, such a treatment could also be used by saturating the airflow blown through the receptacle with steam from a treatment product which can be water or an aqueous solution of products of a chemical or biological treatment. In this case, a liquid water injection member or an aqueous solution injection member is provided which works in a warm battery of an evaporator-condenser of the treatment device, or by atomization in a power-driven fan of the treatment device.

In particular, the treatments of heating and cooling, dehumidification and humidification of the treatment air carried out by the treatment device can be such that the air is either the only treatment element of the products to be dried or that it is the vector of another treatment product or effect such as cold or heat.

It will also be noted that the treatment process of the invention permits regulating or controlling the flow rate of treatment air by controlling the power of the motor-driven fans or the pressure drop particularly through the registers A to E described above. Such a regulation can constitute by itself a particular treatment of the products to be treated in receptacles such as a mechanical agitation of portions of these products or to carry away dust associated with these products.

Among the treatments envisageable with the help of the device of the invention, it will be noted that the dehumidification treatments of the treatment air must be controlled because the dried treatment air thus acts like a sponge which will extract moisture from products to be treated in the receptacle 20. As a result, the central automaton 22 of the device of the invention comprises a module adapted to add external air which will be more humid, to avoid over-drying the products to be treated.

The device of the invention, more particularly the thermodynamic machine, comprises a reversing valve which permits principally reversing the operation of the thermodynamic cycle. It thus permits changing the functions of the condenser or of the evaporator among the two evaporator-condensers of the machine. This reversing valve has been shown in FIG. 4 with as a "three-way" valve and several expanders or non-return valves to ensure its operation. The same result could be achieved with a "four-way" valve with a slide with two positions actuated under the control of the central automaton 22.

The central automaton 22 also comprises a control module to regulate the assembly of predetermined values of the operating parameters. Such a control module can be accessible to the user to input initial values of the operating parameters or reference values or alarm values, as has been described above.

The central automaton 22 also comprises a module for regulation of the treatment program by means of the control module, in which the reference and alarm values are compared to detected or estimated values of the operating parameters at each instant so as to achieve the objects and results of treatment as has been described above.

It will be understood that the modules of the central automaton 22 are essentially comprised by macro-programmable functions and electronic power circuits to control the operation of the electrical motors and the actuators described above.

In one embodiment, the treatment device of the invention also comprises a module for exploiting the energy A1 recovered during treatment of the treatment air by the thermodynamic machine. Such a module could comprise an independent circuit of a heat exchange fluid which recovers the cooling energy of the treatment air and which circulates toward a heating radiator or toward a means for recycling energy.

The invention claimed is:

1. Process for treating products (P) with air treated by a thermodynamic treatment machine, comprising the steps of:

a) calculating, for a treatment objective, the operating regime of the thermodynamic treatment machine defined by an assembly of predetermined operating parameter values, comprising:
   - the operating condition of power driven fans (7, 11) driving the air to be treated through the treatment machine;
   - the opening position condition of registers (13–16; 9) for access of the air to be treated by the treatment machine;
   - the operating condition of the compressor or compressors of the treatment machine;
   - the switching condition of a reversing valve reversing the operation of the thermodynamic treatment machine;
   - the quantity of products (P) to be treated;
   - a theoretical quantity of water (Qtheo) to be extracted per unit time, said theoretical quantity (Qtheo) being determined by:
     - the nature of the products (P) to be treated;
     - the desired duration of treatment, the treatment objective predetermined by a combination of at least:
   - a quality treatment criterion measured on the products; (P)
   - a duration of treatment;
   - a consumption of electricity by the treatment machine;
   - an economical cost;

b) loading into a receptacle, at least partially closed (20), a load of products (P) to be treated;

c) removing, at most, a fraction of the air from the load of products (P), and making a determination concerning mixing with external air;

d) controlling the flow rate, the temperature and/or the quantity of moisture saturating the treated air so as to produce a treated airflow, such that there will be applied a treatment of dehumidification, humidification, heating and/or cooling of the treatment air; and e) reinjecting at least a portion of the treated airflow into the load (P); and f) applying the treatment steps c)–e) until said treatment objective is achieved for said assembly of predetermined values of the operating parameters.

2. Process according to claim 1, further comprising the step of measuring the quantities of water contained in the air including:

a second water quantity (Q2) in the external air outside the treatment machine or in the receptacle (20) containing the products to be treated;

a third water quantity (Q3) in the treated airflow from the treatment machine (1);

and if the second water quantity (Q2) is measured on the external air, measuring a first water quantity (Q1) in at least the receptacle (20) at least in an air filled portion (A) of the receptacle, containing products (P) to be treated.

3. Process according to claim 2, comprising the further step of carrying out a dehumidification or a humidification of the treated air and in reinjecting at least a treated fraction at least into the receptacle (20), if the measured second water quantity (Q2) is greater than the predetermined theoretical quantity (Qtheo) of water.

4. Process according to claim 2, comprising the further step of applying heating to the treated air and reinjecting at least a fraction of treated air at least into the receptacle (20), if the measured second water quantity (Q2) is smaller than the predetermined theoretical quantity (Qtheo) of water.

5. Process according to claim 2, comprising the further step of applying cooling to the treated air and re-injecting a treated fraction at least into the closed volume (20), to carry out preservation of treated products (P).

6. Process according to claim 2, comprising the further step of applying a mixture of a predetermined fraction of external air to a portion of the air undergoing treatment, so as to avoid over-drying of the products to be treated.

7. Process according to claim 2, comprising the further steps of:

if the measured first water quantity (Q1) is greater than the measured second water quantity (Q2), taking the air to be treated principally from the receptacle (20; portion A), if the measured second water quantity (Q2) is greater than the measured first water quantity (Q1), in taking the air to be treated principally from outside the receptacle (20), and if the measured third water quantity (Q3) is greater than the theoretical quantity (Qtheo) of water, in reducing the treatment power, by determining the operating condition (A) of the fans and/or the operating condition of the compressor or of a stage of the compressor.

8. Process according to claim 1, comprising the further step of carrying out a mixture of a predetermined fraction of air to be treated with a portion of the air in the course of treatment.

9. Process according to claim 1, wherein the quality treatment criterion measured on the products (P) includes the weight of dry material.

10. Treatment device for treating produces with treated air, comprising:

at least one receptacle (20) containing products (P) to be treated and an air containing portion (A) in which air to be treated is located;

a sealed cabinet (1; 21) comprising a file of treatment compartments (2–5) and a thermodynamic machine (40–61) as well as an access door (6, 12) in each of the end compartments connected to a passage (23, 24) for communication of air with at least one receptacle (20), a passage (23) for recycling being installable;

a programmable automaton (22) connected to a plurality of detectors of parameters of operation (Q1–Q3, Text, Tevaporator);

a source of electrical supply (25);

the automaton (22) comprising a module to carry out a program (27) using the process of claim 1, such that a plurality of operating parameters comprising the conditions of opening positions at registers for access to the compartments of the sealed cabinet (21), the control of a reversing valve, the control of power driven fans, of two evaporator-condensers and of a compressor, the thermodynamic machine being comprised by a heat transfer circuit comprising two evaporator-condensers, the reversing valve and the compressor, so as to achieve said treatment objective set forth at step a) and recorded in the module (27) to carry out said program.

11. Device according to claim 10, characterized in that at least one treatment compartment (2–5) comprises a register (13–16; 9) whose opening condition ("O", "C") is determined by the automaton (22), the register being connected to the air in the receptacle (20) or to the outside air, or to both.

12. Device according to claim 10, characterized in that it comprises a register (9) disposed between two central compartments (3, 4) and separating batteries of the evaporator-condensers (8, 10) whose opening condition ("O", "C") is determined by the automaton (22), preferably open in a dehumidification mode for the air.

13. Device according to claim 10, characterized in that the thermodynamic machine (40–61) comprises a reversing valve (52, 53, 58) controlled by the programmable automaton (22) such that the thermodynamic machine produces at least one operating mode from among the operating modes of cooling or heating.

14. Device according to claim 13, characterized in that the programmable automaton comprises control means for regulating said assembly of predetermined values of parameters of operation such that the device works accordiag to an operating mode taken from among four operating modes: heating, dehumidification, humidification or cooling.

15. Device according to claim 14, characterized in that the power driven fans of the evaporator-condensers (7, 11) and at least one compressor or a compressor stage of the thermodynamic machine, to be operating fully or to be not operating.

16. Device according to claim 15, characterized in that it comprises a regulation module for treatment by mixing with external air and/or with the air to be treated of which outlet means control the opening condition of at least one of the registers (A–E) which are connected by passages to the external air and/or to the air from the air containing portion (A) of at least one receptacle (20).

17. Device according to claim 10, characterized in that it also comprises at least one module for using energy recovered during treatment of the air from at least one receptacle (20) containing products to be treated.

18. Device according to one of claims 10 to 17, characterized in that it comprises a frost detector on at least one battery of the evaporator-condensers and a control module to cause the heat transfer circuit to pass to the heating mode at least while frost is detected by the frost detector or for a predetermined duration.

19. Device according to claim 10 characterized in that it comprises a remote control module comprising:

a module (T1) adjacent the automaton (22) which comprises a circuit to detect values of operating parameters of the machine including three air water quantity measurements (Q1 to Q3), the operating conditions of the fans and of the compressors of the thermodynamic machine, the open condition of the registers, the consumption of electricity, a circuit to detect alarm values of the values detected of the operating parameters, at least one alarm value is achieved, a circuit to transmit an assembly of instantaneous values and/or a history of this assembly for a predetermined period, a circuit to receive values of the control parameters and reference values disclosed such that the operation of the device will be changed;

a module (T2) disposed remotely and which comprises a circuit to receive data from the module (T1) and particularly an alarm signal, and a history of the values and parameters of operation of the machine, a circuit to determine as a function of the received values of the operating parameters of the machine, new reference values and/or control values of the operating parameters of the machine, a specialized connection between the modules (T1, T2) such that said assembly of predetermined values of operating parameters of the device will be adapted to accidental circumstances signaled by the alarms, the first water quantity measurements being a first water quantity (Q1) in at least the receptacle (20) in an air filled portion (A) of the receptacle containing products (P) to be treated, a second water quantity (Q2) in the external air outside the treatment machine, and a third water quantity (Q3) in the treated airflow from the treatment machine (1).

* * * * *